United States Patent [19]

Aurich et al.

[11] 4,001,945

[45] Jan. 11, 1977

[54] WET PROCESSING MEANS

[75] Inventors: Christoph W. Aurich, Clemson, S.C.; James Keith Turner, Lincolnton, N.C.

[73] Assignee: Gaston County Dyeing Machine Company, Mount Holly, N.C.

[22] Filed: Sept. 24, 1975

[21] Appl. No.: 616,152

Related U.S. Application Data

[60] Division of Ser. No. 381,268, July 20, 1973, Pat. No. 3,921,420, which is a continuation-in-part of Ser. No. 318,087, Dec. 26, 1972, abandoned.

[52] U.S. Cl. ..... 34/155; 34/160; 68/20

[51] Int. Cl.[2] ..... F26B 13/00

[58] Field of Search ..... 68/5 C, 20, 177, 178, 68/DIG. 1; 34/155, 160, 221, 228

[56] References Cited

UNITED STATES PATENTS

| | | | |
|---|---|---|---|
| 3,074,178 | 1/1963 | Kabelitz et al. | 34/160 X |
| 3,495,932 | 2/1970 | Tuma | 34/160 X |
| 3,718,012 | 2/1973 | Vinas | 68/177 X |

FOREIGN PATENTS OR APPLICATIONS

| | | | |
|---|---|---|---|
| 1,785,141 | 12/1972 | Germany | 68/177 |

*Primary Examiner*—Philip R. Coe
*Attorney, Agent, or Firm*—Richards, Shefte & Pinckney

[57] ABSTRACT

A method and means are provided having particular significance for dyeing textile strand material by circulating such material in a confined space, preferably, under the aspirating influence of jetted inert gas, and applying a treating liquor formulated for effective application at a short liquor ratio, preferably, by metering the same into the gas as it is supplied to produce the aspirating influence. Excellent distribution of the treating liquor throughout the material is obtained in this manner, while spent liquor effluent is materially reduced.

3 Claims, 9 Drawing Figures

WET PROCESSING MEANS

CROSS-REFERENCES TO RELATED APPLICATIONS

This is a division of copending application Ser. No. 381,268, filed July 20, 1973, and now U.S. Pat. No. 3,921,420, which was in turn a continuation-in-part of application Ser. No. 318,087, filed Dec. 26, 1972, and that was abandoned in favor of the copending application upon its subsequent filing.

BACKGROUND OF THE INVENTION

At 88, 9–14 of the Journal of the Society of Dyers and Colourists (January 1972), an aqueous dyeing system is described in which exceptionally short liquor ratios are successfully employed by formulating the dyestuff with a foaming agent and converting the liquor to a foam on and in the substrate before raising temperature to fix the color. General application of the described technique for wet processing of all sorts is indicated.

The short liquor ratios involved (i.e., ratio of substrate weight to weight of treating liquor) are, in general, of the order at which no liquor exists outside the substrate following distribution of the treating liquor therein. For special purposes, such as to enable migration to occur during blend dyeing, it may sometimes be desirable to produce liquor outside the substrate by adding water to the system, but even so the liquor ratio employed will still be materially reduced from that usually employed in conventional dyeing and will normally be of the order first indicated.

Principal factors in obtaining effective application of treating formulations at such short liquor ratios are selection of a liquor ratio and foaming agent concentration at which distribution of the formulation through the substrate in a reasonable time is possible, and imposition of incidental mechanical forces on the substrate as it is handled during application of the formulation. In the latter connection, good results are reported for garments and half hose when treated with a dyestuff formulation in rotating drum equipment which subjects such articles to a tumbling action. Apparently such action generates a foamed condition of the applied formulation within the substrate that promotes excellent distribution.

The problem of providing a practicable application technique and apparatus arrangement for obtaining comparable results on piece goods and the like has remained, however, and it is the solution of this problem to which the present invention is directed.

SUMMARY OF THE INVENTION

The aforesaid problem is solved at particular advantage according to the best mode contemplated for carrying out the present invention by a unique adaptation of the manner in which textile piece goods have heretofore been handled for wet processing by circulating them through a treating bath in endless strand form under the influence of a venturi-induced jet of a cycled portion of the bath.

Such previously established processing practice is adapted for effective use in foaming the treating formulation and distributing it evenly through the substrate in accordance with the present invention by arranging to circulate the piece goods under the aspirating influence of jetted inert gas, and metering the treating formulation into the gas as it is supplied to produce the aspirating influence.

Imposition of the mechanical forces necessary to develop the foamed condition and even distribution of the applied formulation results both from the influence of the jetted inert gas and from the handling of the substrate otherwise during its circulation, as will appear more fully from the detailed description further below in connection with the accompanying drawings.

DETAILED DESCRIPTION OF THE INVENTION

Figure 1:
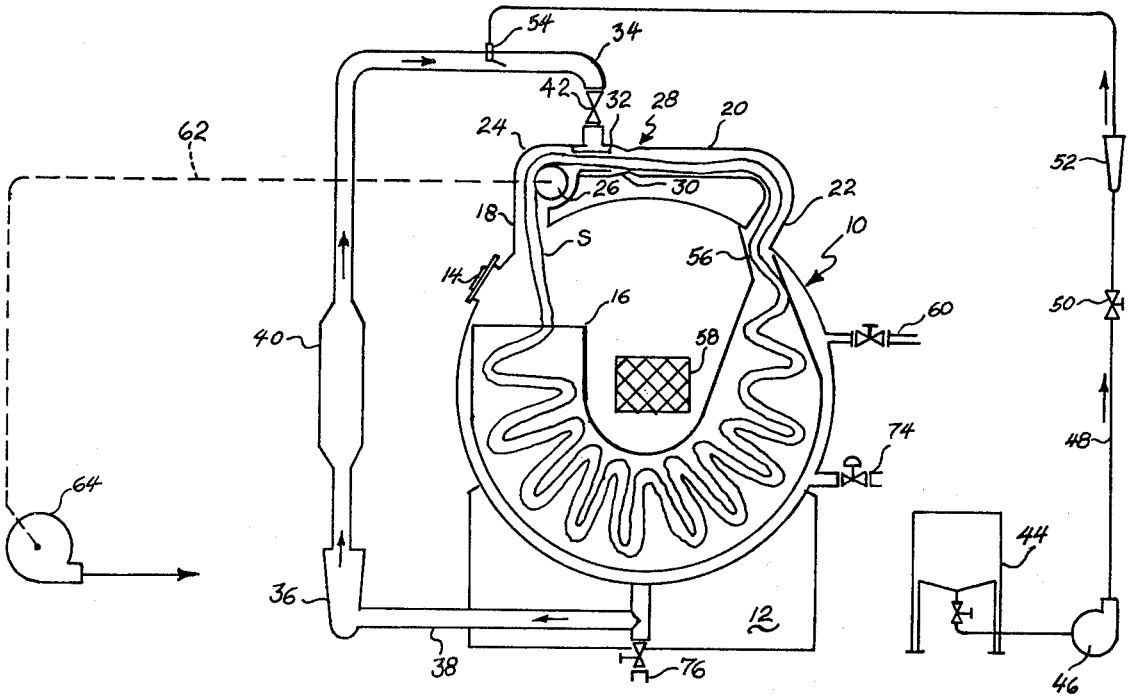
FIG. 1 is a diagrammatic illustration of a representative apparatus arrangement suited for practicing the present invention.
Figure 2:
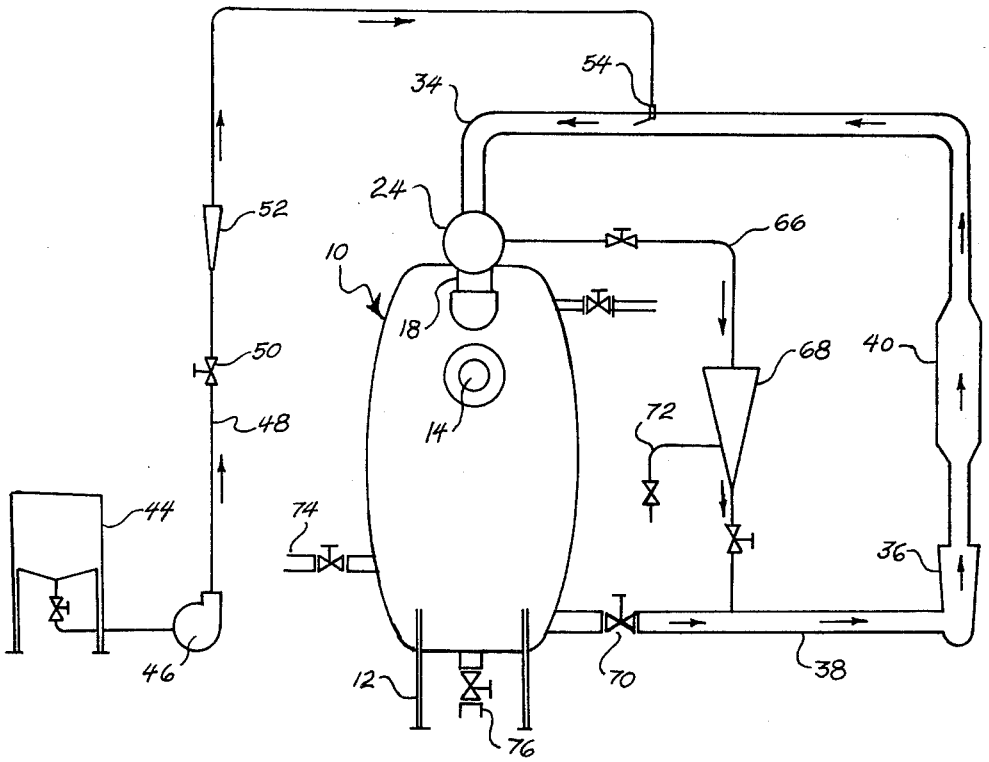
FIG. 2 is a further diagrammatic illustration showing an alternate extraction arrangement.

The apparatus arrangements shown in FIGS. 1 and 2 of the drawings are used first to illustrate the manner in which the present invention is practiced because the operating principles involved were confirmed through development work with apparatus of this sort. It should be noted, however, that while the illustrated apparatus is arranged for batch operation, and more particularly for handling piece goods in endless rope form, the confirmed operating principles are of general application, so that the apparatus can be arranged as well for handling the piece goods in open width form, or for treating other textile strand material such as tow, or for continuous operation, with equally good results.

It should also be noted that when an "inert gas" is referred to in describing the operating procedure it is meant that the gas is inert with respect to the treating liquor and the material being handled. That is, that the gas has no unwanted reactive or other influence on the liquor or the material. Normally the gas employed will be air, although one that is inert in the strict sense, such as nitrogen, can be used whenever there is reason to do so.

In addition, it should be understood that when treating liquor application and distribution is described herein, or referred to in the claims that follow, as being accomplished in a "reasonable time" by strand material circulation at a sufficiently rapid rate, it is meant that application and distribution time is no longer than that required in alternative wet processing procedures, such as jet dyeing or solvent dyeing, and that the strand material is circulated rapidly enough to produce this result. Strand material circulation can, of course, be effected in a variety of ways, as, for example, with a winch system of the sort commonly employed in dye becks or by suitably arranged rolls of various sorts, and any circulation system employed is almost certain to impose the incidental mechanical forces needed to promote even distribution of the treating liquor, but unless the system employed also provides for a sufficiently rapid circulation rate the time required for treating liquor application and distribution can be unreasonably prolonged. It is for this reason that circulation by jetted inert gas is preferred according to the present invention, although it is the rapid circulation rates made possible by circulation in this manner that is of primary significance and any other system capable of producing reasonably comparable circulation rates would also allow application and distribution of the treating liquor in a "reasonable time."

Referring to the drawings in detail, FIG. 1 diagrams an adapted form of apparatus such as is disclosed and claimed in the previously noted copending application Ser. No. 272,774, a cylindrical pressure vessel or kier 10 being mounted on a suitable base 12 with its cylindrical axis disposed horizontally to form a treating chamber. A kier loading port is provided at 14 through which piece goods may be introduced for processing in endless strand or rope form as indicated at S, and removed after processing. Interiorly, the kier 10 is partitioned in J-box fashion as shown at 16 to form a storage or accumulation means for the greater portion of the piece goods strand S as it is circulated within the kier after being introduced and confined therein.

Provision for circulating the strand S during treatment is arranged at a conduit superstructure which includes a vertical intake portion 18 rising from kier 10, a horizontal continuing portion 20, and a terminal discharge portion 22 returning to the kier 10. At the junction of the vertical intake and continuing horizontal portions 18 and 20 an enlarged housing portion 24 is provided to enclose a driven roll member 26, which may be of the specially covered sort disclosed and claimed in copending application Ser. No. 234,495 for lifting purposes, or of the suction type comparable to that disclosed and claimed in copending application Ser. No. 240,010 to provide for extraction as well as lifting. In either case, the vertical intake portion 18 into which the strand S is lifted from kier 10 is situated adjacent the loading port 14 and above the exit end of the J-box storage means 16, and the housing portion 24 at the upper end thereof is formed to enclose the driven roll member 26 at an offset disposition such that the strand S is lifted axially into intake portion 18 by roll member 26 and delivered therefrom axially to the continuing superstructure portion 20.

In this continuing horizontal portion 20, just beyond roll member 26, a venturi structure 28 is formed. Except for the roll housing portion 24, the other superstructure portions preferably have a lengthwise tubular form that is enough larger in cross section at all points than the strand material S to allow for passage of this material freely therethrough, and the venturi structure 28 is formed by a tapered necking of the horizontal continuing portion 20 at 30 and the installation of a venturi tube 32 thereat. The installed venturi tube 32 is arranged concentrically within the continuing portion 20 so that its downstream and is spaced to provide an annular nozzle at the necking 30 that is fed through a piping connection at 32. The upstream end of venturi tube 32 is flared to receive strand material S delivered by the roll member 26 readily, and is adjacently sealed within the continuing superstructure portion 20 so that the feed through piping connection 34 can escape only through the annular nozzle at necking 30.

An aspirating influence is induced at the venturi structure 28 from a blower 36 that is connected, as indicated at 38, to draw from the interior of kier 10 and to deliver through a heat exchanger at 40 and throttle valve at 42 to the venturi structure at feed connection 34. The short treating liquor is metered into the blower feed to the venturi stucture from a mixing tank 44 by a pump 46 connected for delivering formulated treating liquor from tank 44 through an add line 48 having a throttle valve 50 and flow meter 52 installed therein and a nozzle 54 at the downstream end thereof that is fitted to the blower delivery leg 34 so as to discharge therein ahead of (i.e., upstream of) venturi structure 28. The resulting influence at the venturi structure 28 is one of aspiration from the jetted discharge of the blower feed and of distributive application of the metered treating liquor carried by the blower feed. The aspirating influence serves to forward the strand material S through the remainder of the superstructure and also to impose mechanical forces on the strand S by which even distribution of the applied treating liquor is promoted as mentioned earlier.

The forwarded strand material S is returned to the kier 10 through the superstructure discharge portion 22 with the flow of air (or other inert gas) resulting from the jetted blower feed and with the applied treating liquor carried in the material. Within kier 10 a baffle member 56 is disposed adjacent the returning end of superstructure discharge portion 22 for deflecting the circulating strand S and thereby imposing further incidental mechanical forces in aid of treating liquor distribution as well as directing orderly transient accumulation of the returning strand material in the J-box storage means 16. Additional mechanical forces are incidentally applied to the strand material S as it progresses through the J-box storage means 16 and as it is handled by the lifter roll 26 so as to produce a very thorough and even distribution of the treating liquor in the strand material as a result of its circulation.

A typical piece goods dyeing operation carried out according to the present invention in appartus arranged in the foregoing manner starts with loading the kier 10 by introducing one end of the piece goods through the loading port 14 and directing it over roll member 26 with the drive thereto running and with blower 36 operating to feed the venturi structure 28 with air, so that the goods are progressively forwarded through the superstructure and returned to the J-box storage means 16 in kier 10 where the leading end will work its way within reach through the loading port. A leader is helpful in expediting this step.

When the leading end of the goods can be reached it is withdrawn through loading port 14 and sewn to the trailing goods end and the entire piece goods length to be treated is placed within kier 10 to form the endless strand or rope S arranged therein as indicated in FIG. 1. The kier 10 should provide a unit load capacity of about 250 pounds. The kier 10 can, of course, be elongated horizontally to accommodate multiple strand handling arrangements of the FIG. 1 sort, and when this is done the load capacity should increase by a corresponding multiple. A polyester/acrylic fabric treated in apparatus generally comparable to that shown in FIG. 1 formed a strand S of approximately 450 yards.

With the strand S loaded and circulating, the next step is to apply the dyestuff which will already have been formulated in the mixing tank 44. For the polyester/acrylic fabric noted above, a disperse dye for the polyester and a basic dye for the acrylic were selected to produce a blue/pink heather shade. These dyestuffs were formulated in usual fashion, except that a foaming agent was added as taught by the previously mentioned publication, and the formulation was prepared at a liquor ratio of 1:2.0. A more generally suitable ratio has been found to be 1:1.5. Shorter ratios can be employed, but even distribution becomes difficult if the ratio is made too short. Longer ratios can also be used when desired, although if a ratio of about 1:2.5 is exceeded liquor is apt to exist outside the substrate and this condition should be avoided unless particular circumstances require it.

For application of the dyestuff, the apparatus should be arranged to circulate the strand S at about 300 yards per minute and the dyestuff formulation should be metered into the air stream ahead of the venturi structure 28 so that it has been added in about 15 minutes. With the above-noted polyester/acrylic fabric the add rate was 4.5 gallons per minute, which was set by the throttle valve 50. After full addition of the dyestuff, circulation of the strand s is continued for a comparable period (i.e., about 15 minutes) to obtain through distribution, while temperature within the kier 10 is maintained below that at which the dyestuff becomes substantive (e.g., usually below about 100° F.) throughout this initial portion of the processing. For this latter purpose, the heat exchanger 40 is operated to supply whatever cooling effect is needed to counter-act heating of the air feed to venturi structure 28 by blower 36.

Upon application and distribution of the dyestuff in the foregoing manner, the dyestuff is caused to strike by elevating the kier temperature with the loading port 14 closed so as to pressurize the kier and aid in suppresssing moisture loss. The heat exchanger 40 is used for this purpose, together with a supplementary heating means 58 arranged within kier 10 and a steam line 60 through which steam is fed to kier 10 to maintain an even moisture level in the strand S during the temperature elevation. For the polyester/acrylic fabric previously noted a fixing temperature of 250° F. was needed, and was reached in 30 minutes, after which circulation was continued for a like period at this temperature.

Following dye fixation, the strand S can be extracted and rinsed if the roll member 26 is of the suction type as previously mentioned. Because the roll member 26 has an important lifting function in assisting circulation of the strand S, if it is of the suction type it will usually be desirable to maintain a light suction thereat sufficient to assure adequate tractive action during normal operation, while providing for increasing the suction when extraction is desired. FIG. 1 indicates an arrangement for impressing suction at roll member 26 through a line 62 running to a vacuum pump 64 that exhausts externally of the system. As suction type rolls are characterized by a perforate working surface, when line 62 is arranged to draw at the interior of a suction type roll member 26 extraction of the strand S trained thereover will result, and the extract will be dumped by the externally exhausting vacuum pump 64.

If such extraction is provided for and desired, the heat exchanger 40 should first be operated to bring the kier temperature below the boiling point of water (e.g., to about 180° F.) so that kier 10 can be opened to the atmosphere at loading port 14 during the extraction. With the strand S still circulating, the vacuum pump 64 is placed in full operation to extract foam and moisture. The extraction should be continued during at least two complete circulations of the strand S. Then a water rinse may be applied using the same facilities provided for the dyestuff application and at the same liquor ratio (about 1:1.5). About four circulations of the strand S should be allowed for the rinse water application, after which a second extraction and rinse followed by a final extraction will place the goods in excellent condition for unloading and subsequent handling. Total processing time of 2 to 2½ hours, including such extraction and rinsing, is normal.

FIG. 2 diagrams an alternate arrangement for impressing suction at the roll member 26 through a vacuum line 66 running through a water separator 68 to the suction leg 38 for blower 36 beyond a throttle valve 70 which may be adjusted to obtain the level of suction desired in vacuum line 66. The separator 68 is provided with a drain at 72 for dumping the extract.

Both the FIG. 1 and FIG. 2 arrangements additionally include a water line 74 to kier 10 and a kier drain at 76 for general utility purposes. It should be noted that for simplicity of illustration the kier drain 76 is shown as being connected to kier 10 in common with the suction leg 38 of blower 36, but that in practice some provision (not shown) would be needed to prevent any liquid collecting at the bottom of kier 10 during blower operation, such as condensate, from being drawn into the blower suction leg. Usually, it will be easiest to make such provision by connecting the blower suction leg 38 separately at a level above that of any likely or intended liquid accumulation in kier 10 during blower operation. Also, it may be desirable to connect a valved branch line (not shown) from kier drain 76 to pump 46 so that any condensate or other liquid collecting in kier 10 during processing which contains significant treating agent may be returned to the blower feed at venturi 28 for reapplication to the goods being handled.

The further apparatus embodiment illustrated by FIGS. 3 through 9 of the drawings represents, as mentioned earlier, an equipment design incorporating certain modifications developed in adapting the invention fully to the practical considerations of production use. In the main, these modifications are concerned with the superstructure arrangement provided for effecting circulation of the strand material to be treated, and with an improved extraction means included in the modified superstructure arrangement.

Figure 4:
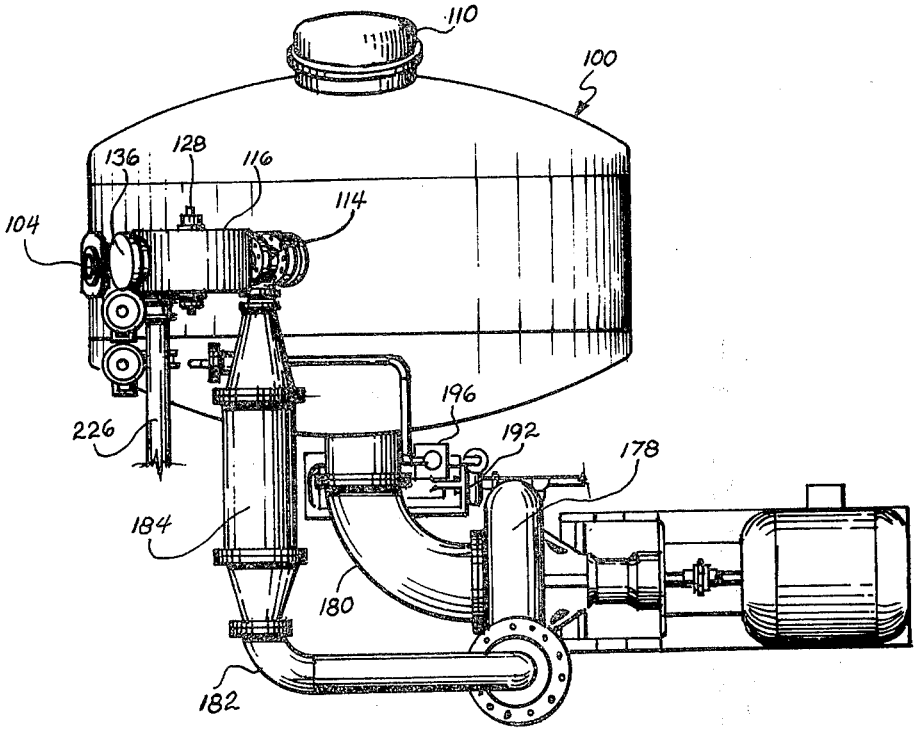
FIG. 4 is a plan view corresponding to FIG. 3.
Figure 3:
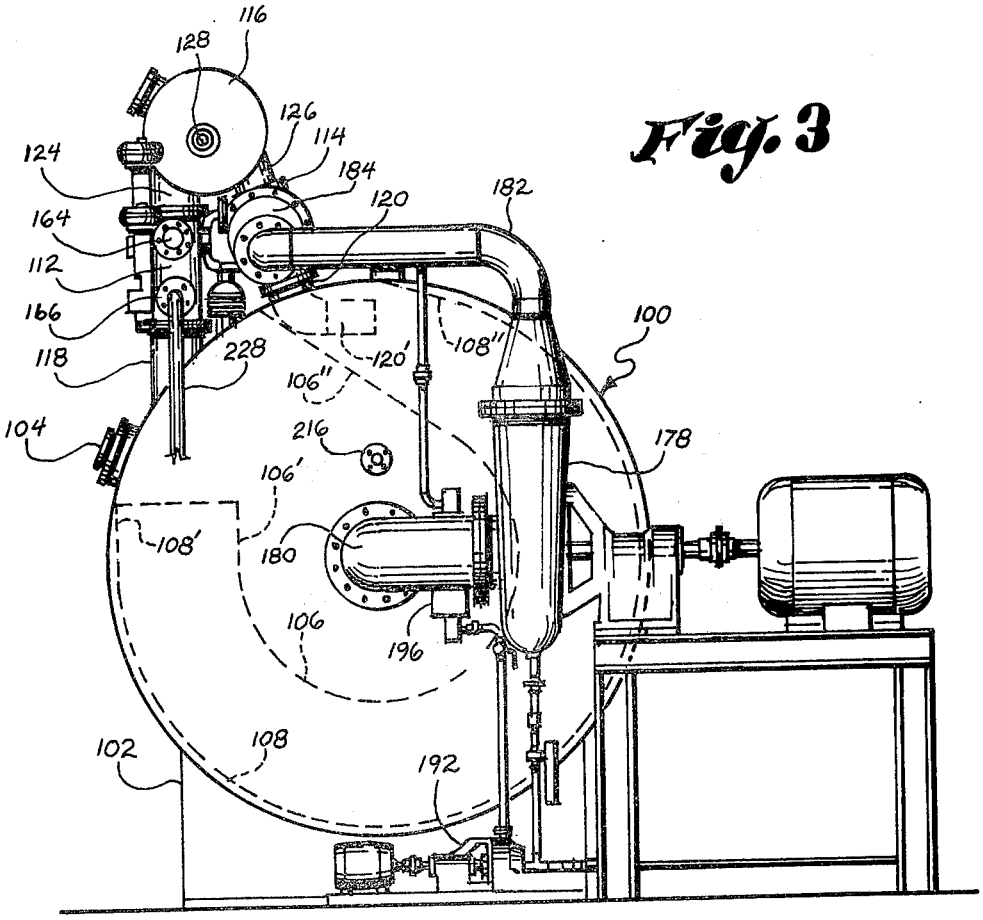
FIG. 3 is a side elevation of apparatus modified in certain particulars as has been found advantageous in adapting the invention to production use.

Referring at first to FIGS. 3 and 4, the modified apparatus embodiment illustrated will be seen again to comprise a cylindrical pressure vessel or kier 100 mounted to stand on a base 102 with its axis disposed horizontally to form a treating chamber. Also, as before, the kier 100 is provided with a loading port at 104 and with internally spaced J-box partitioning, as indicated in dotted lines at 106 and 108, to form a storage or accumulation space for the greater portion of the strand material being treated, although it should be noted that in this instance the J-box partitioning 106 and 108 has a special configuration for relating it to the modified superstructure arrangement and that the superstructure arrangement provides an additional loading port as will be pointed out further presently. In addition, the kier 100 is fitted with an inspection and access port 110 (see FIG. 4) through which the kier interior can be viewed during processing operation and at which the kier can be opened to the atmosphere whenever desired or access to the interior can be gained whenever necesary.

The modified superstructure arrangement provided for the presently described embodiment includes a vertical intake leg 112 rising from the kier 100, an inclined discharge leg 114 returning to the kier 100, and an enlarged housing 116 forming a junction of these legs, as illustrated generally in FIGS. 3 and 4 and detailed further in FIGS. 5 to 8. The intake and discharge legs 112 and 114 have a lengthwise tubular conduit form proportioned in cross section for circulation of strand material freely therethrough, and the intake leg 112 into which the circulating strand material is lifted from kier 100 is mounted at a flanged kier outlet 118 arranged adjacent the loading port 104 and aligned vertically above the exit end of the J-box configuration formed by the interior kier partitioning 106 and 108 which terminates in vertical portions at 106' and 108' for such alignment.

A flanged kier inlet 120 is also provided for mounting the superstructure discharge leg 114 at an inclination such that the wrap of circulating strand material about a lifter roll 122 installed in the superstructure junction housing 116 approaches 180° as nearly as possible, which as a practical matter will normally mean a wrap in the order of 160°. This inlet fitting 120 is extended interiorly of kier 100 in elbow fashion so as to terminate in a horizontal portion 120' (see the dotted indication in FIG. 3) within the entrance portion of J-box partitioning 106 and 108 at which the inner partitioning 106 is formed with an extended flat section at 106'' and the outer partitioning 100 with a flat section 108'' of lesser extent.

Both of these flat sections 106'' and 108'' are inclined in tangent relation to the continuing arcuate form of the J-box partitioning and extend to the inner kier wall face so as to form an entrance portion that is closed except for restricted perforations (not shown) adjacent the upper end of inner flat section 106'' that serve to release the aspirating gas discharge sufficiently to avoid an undue pressure buildup in the entrance portion while maintaining a static pressure thereat which materially assists in movement of the accumulated strand material through the J-box space. The J-box space is completed in usual fashion by side closures which, together with the partitioning 106 and 108, is imperforate except for the above-noted gas release perforations and such additional perforations (not shown) as are needed adjacent the kier bottom for drain purposes. If provision is made for multiple strand handling, as diagrammed in FIG. 9, a J-box space of the foregoing form is provided for each strand to be handled.

The horizontal terminal portion 120' of inlet fitting 120 has the related significance of causing the aspirating gas discharge to project the returning strand material against a facing area of the outer J-box partitioning 108 from which it then falls away in a varying pattern toward the lower end portion of inner flat section 106'' to be directed therefrom into the continuing J-box space for accumulation. As a result the returning strand material is immediately subjected to substantial and repeated impact forces serving importantly to promote effective treating liquor foam generation and distribution. In addition, the initial projection of the strand material into the J-box space in the foregoing manner produces an orderly piling of the strand material therein that facilitates its movement therethrough and particularly eases its lifting from the exit end into the superstructure at which circulation is effected.

Figure 6:
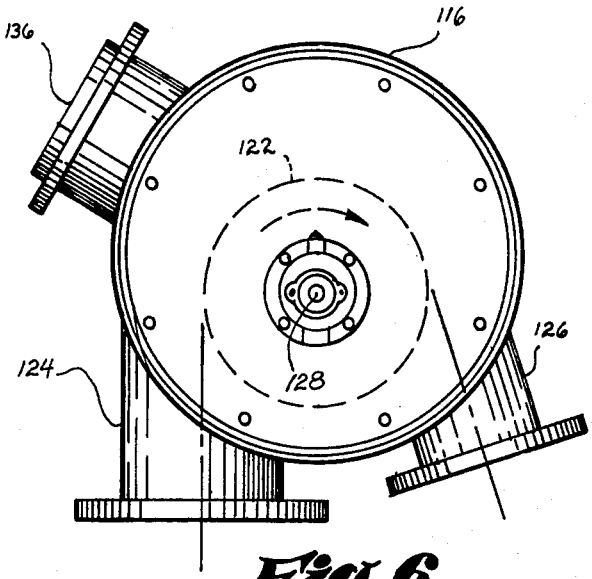
FIG. 6 is a side elevation of the superstructure junction housing.
Figure 7:
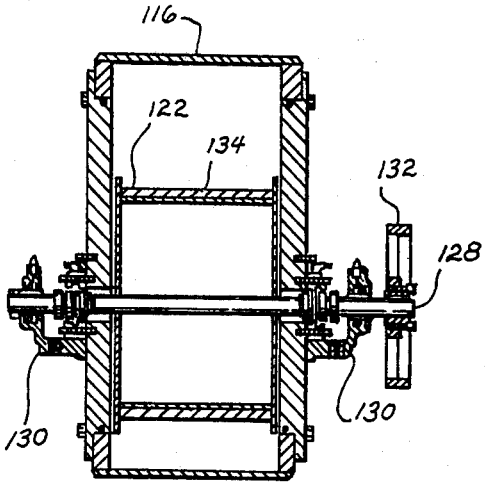
FIG. 7 is a vertical central section corresponding to FIG. 6.
Figure 5:
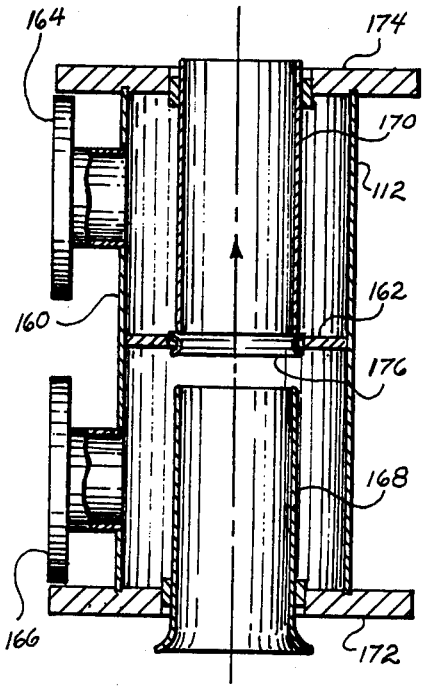
FIG. 5 is a longitudinal central section of the vertical intake leg of the FIG. 3 apparatus superstructure.

Lifting of the strand material from the J-box exit end into the vertically aligned superstructure intake leg 112 is accomplished by the previously mentioned lifter roll 122 which is installed in junction housing 116 as illustrated in FIGS. 6 and 7. Flanged tubular fittings 124 and 126 are provided at housing 116 for assembling it with the superstructure intake and discharge legs 112 and 114 in junction relation, and the lifter roll 122 is carried in housing 116 on an axial shaft 128 that is positioned to align the roll surface tangently with the central axes of both superstructure legs 112 and 114 so that circulating strand material is received at and delivered from this surface without materially affecting centered passage thereof through legs 112 and 114 (see FIG. 6). The axial roll shaft 128 projects at both ends from housing 116 through suitable sealing means to outboard bearing mounts at 130 adjacent one of which it is fitted with a pulley 132 (see FIG. 7) to provide for driving lifter roll 122 during processing operation.

In order to provide effective tractive reaction at the surface of lifter roll 122 for performing its lifting action, a suitably tractive surface covering 134, preferably of the sort described and claimed in previously noted copending application Ser. No. 234,495, is advantageously employed. In this connection, it should also be noted that the substantial strand material wrap about roll surface 134 resulting from the modified superstructure arrangement of the presently described embodiment, as mentioned earlier, materially enhances the tractive reaction obtained and maintains its practical effectiveness for a wide range of strand materials. It was also mentioned earlier that the modified superstructure arrangement now being considered provides an additional loading port which should now be noted as arranged on housing 116 at 136. This additional loading port is provided because the venturi-jet, at which the aspirating influence for strand material circulation and treating liquor application is produced, is installed in the superstructure discharge leg 114 so that capability for loading strand material at housing 116, or of introducing a loading leader thereat, substantially facilitates the loading step.

Figure 8:
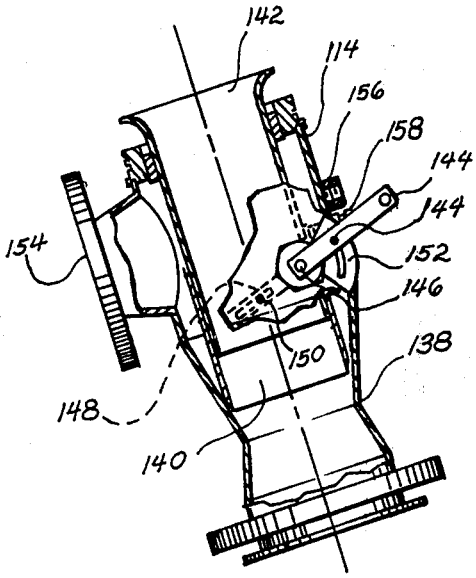
FIG. 8 is a longitudinal central section of the inclined discharge leg of the superstructure.

The installed venturi-jet arrangement in superstructure discharge leg 114 is illustrated in FIG. 8. As shown, the conduit configuration of leg 114 includes a tapered necking at 138 in relation to which a composite venturi tube comprising a movable section 140 slidably telescoped on a fixed section 142 is interiorally arranged. The fixed venturi tube section 142 is flared at its upstream end for receiving strand material readily thereat, and is mounted adjacent this end to seal the surrounding venturi chamber, while the downstream end of movable venturi tube section 140 is chamfered to form an inwardly directed annular orifice at the tapered necking 138 oriented in the direction of strand material circulation.

Positioning of movable section 140 is effected from an external lever structure 144 fixed to pivot pins 146 at opposite sides of discharge leg 114 which extend therethrough to carry internal lever arms 148 having elongated slots adjacent their extending ends in which pins 150 ride that are carried by movable section 140. By this arrangement, the annular venturi orifice at tapered necking 138 can be adjusted through shifting of the movable venturi tube section 140 from external lever structure 144, which is a feature of particular convenience when a different character of strand material to be handled requires such adjustment. A slotted sector bracket 152 is suitably provided for fixing the lever structure 144 at a given setting by means of a clamp screw at 144', and, if desired, this sector bracket 152 may bear suitable indicia for indicating the size of venturi orifice provided at a given lever structure setting. In addition, discharge leg 114 is provided with a lateral inlet fitting 154 at which a supply line for the aspirating gas can be connected to feed the venturi chamber, as well as with a tap fitting 156 for installation of a pressure gauge to indicate chamber pressure, and with at least one and preferably three symmetrically spaced positioning studs 158 that may be adjusted in radial extent to bear without binding at the outer face of movable venturi tube section 140 to maintain it and the adjacent end of fixed section 142 centered against the feeding force of the aspirating gas supplied through lateral inlet 154.

The remaining intake leg component 112 of the modified superstructure incorporates the improved extraction means mentioned earlier, as illustrated in FIG. 5. For providing extraction capability, the intake leg 112 includes a concentric housing member 160 enclosing an annular space that is divided into upper and lower chamber portions by a medially fixed annular partition 162, with a lateral inlet fitting 164 opening into the upper chamber and a lateral outlet fitting 166 opening from the lower chamber. A coaxially mounted intake tube 168, having its upstream end flared as shown, is extended from the lower end of intake leg 112 into the lower chamber short of the medial partition 162, and a similarly mounted delivery tube 170 of corresponding diameter is disposed within the upper chamber above medial partition 162. These intake and delivery tubes 168 and 170 are carried in respective bottom and top flanges 172 and 174 completing the intake leg 112, and are axially adjustable therein for setting the spacing of their extending ends in relation to medial partition 162. Finally, the inner periphery of medial partition 162 is fitted with a jet-forming ring 176 by which an annular orifice is provided at the spacing below the adjacent end of delivery tube 170 that is directed both inwardly and oppositely with respect to the direction of cloth circulation and that may be fed through the housing inlet opening 164.

This arrangement is operated for extraction purposes at the conclusion of a wet processing treatment by pressure feeding an inert gas, normally air, to the upper housing chamber so that an inwardly and oppositely directed jet action is applied to the strand material while its circulation is maintained by the venturi-jet in superstructure discharge leg 114. The result is a displacement of moisture in the strand material through strand material penetration by the jet directed gas that generates a gas suspended extract continually as the strand material circulates. The penetrating action of the jet directed gas tends to increase with increasing jet opposition to strand material circulation, but such increase is accompanied by an increase in tension on the circulating strand material which is generally undesirable. Accordingly, an angle of jet incidence should be employed that avoids subjecting the strand material to undue tension under given processing conditions. with a jet of the illustrated configuration having an inside diameter of 4¼inches and an orifice width of ½ inch operating with a 500 c.f.m. air supply on strand material circulating at 300 yards per minute, a reasonable balance of air penetration and tension avoidance has been obtained at a jet incidence angle of 60° with respect to the strand material axis. The gas-suspended extract generated can be drawn off readily for disposal by applying a suction influence in the lower housing chamber through the housing outlet 166 during the extraction in the manner to be noted further shortly in considering the representative operating system diagramed in FIG. 9.

Figure 9:
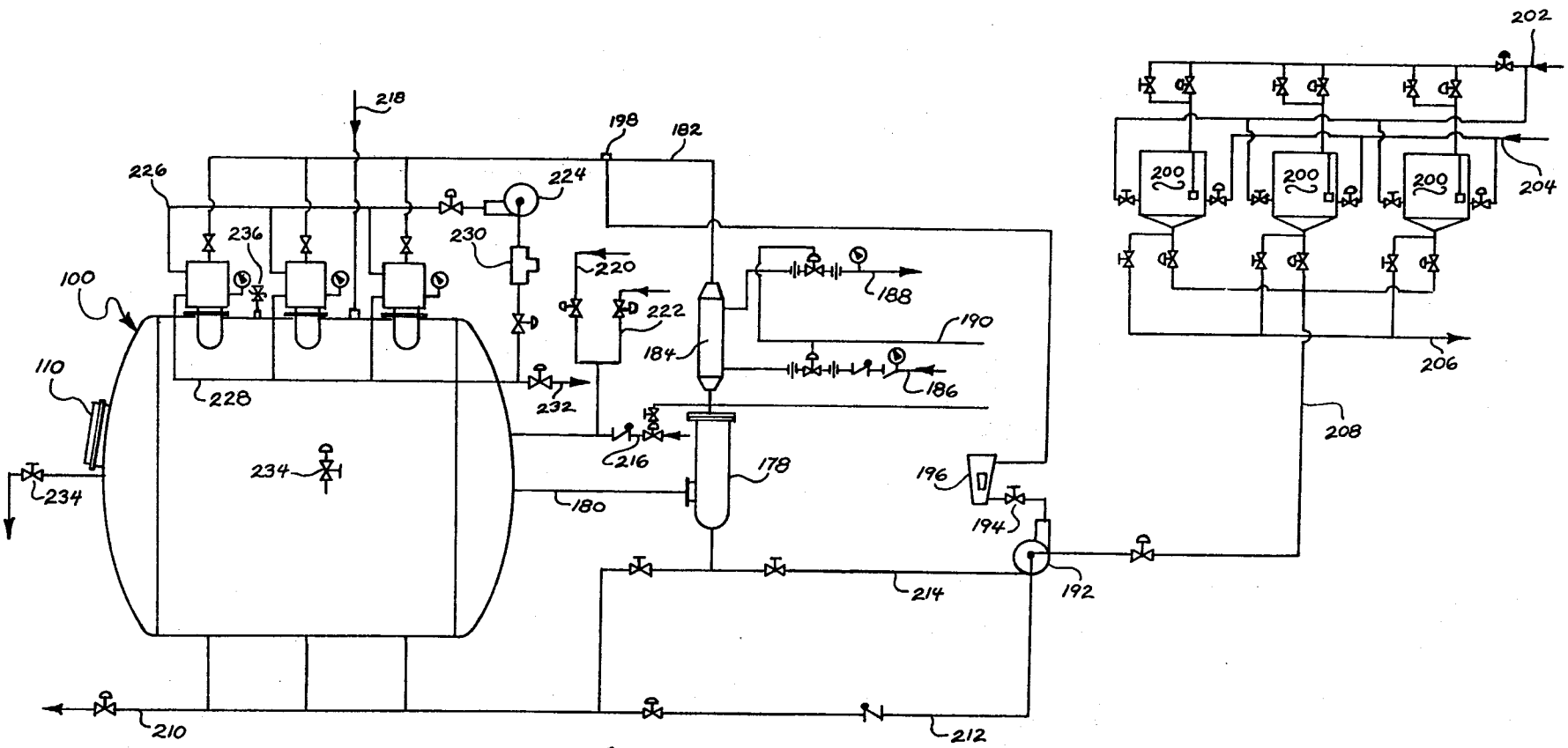
FIG. 9 is a schematic diagram of the operating system associated with the FIG. 3 apparatus.

In FIG. 9, a three-position kier 100 of the FIG. 3 type is indicated which means that a modified superstructure of the sort described above, together with related fittings and internal J-box arrangement, must be provided at each position, but the system diagramed is otherwise representative for any number of positions. The aspirating influence for strand material circulation is produced by a blower 178 that draws from the interior of kier 100 through a suction leg 180 and delivers to the respective venturi-jets in the superstructure discharge legs 114 through a pressure leg 182 in which a heat exchanger 184 is installed (compare FIG. 9 with FIGS. 3 and 4). The heat exchanger 184 is provided to control the air (or gas) delivery temperature at a suitable level until temperature elevation is needed for dye fixing or the like, and for this purpose is arranged with water supply and drain lines 186 and 188 under the control of a cooling signal system at 190 that responds to suitable temperature sensing means (not illustrated) to monitor the heat exchanger throughput for whatever cooling effect is needed.

Introduction of treating liquor for application to the circulating strand material is effected by a pump 192 that delivers through a throttle valve 194 and flow meter 196 to a nozzle 198 installed in the blower pressure leg 182 as mentioned earlier. The treating liquor supply is drawn by pump 192 from a bank of mixing tanks 200 which are provided to allow capacity for preparing a second treating liquor formulation while a first one is being fed, or for making a rinse or scour liquor available for application through pump 192 when desired. Suitable water and steam supply systems 202 and 204 run to the mixing tanks 200 and they are also provided with a drain system 206 as well as being selectively connected at 208 with pump 192.

A kier drain system at 210 is additionally arranged to serve the blower 178 and to allow recycling from either kier 100 or blower 178 to pump 192 through connections at 212 and 214 whenever liquor collecting at the kier bottom or in the blower for any reasons contains enough treating liquor to make recycling desirable. A steam supply line for kier 100 is provided at 216 (compare FIG. 3 with FIG. 9) for use in elevating temperature and maintaining strand moisture content during dye fixing, an air pad supply line at 218 is also preferably provided for use in pressurizing kier 100 to a desired level prior to temperature elevation. The steam supply line 216 is alternatively used for connecting hot or cold water fill lines 220 and 222 with kier 100.

The previously described extraction jet installed in superstructure intake leg 112 is fed with air (or gas) from an auxiliary blower at 224 connected as indicated at 226 to the housing inlet 164 of intake leg 112, while the related housing outlet 166 is connected for discharge through a line 228 which can be arranged to run alternatively to the inlet of auxiliary blower 224 beyond a water or moisture separator 230, or simply to dump at 232. The first alternative employs blower 224 to provide the previously mentioned suction influence for carrying off the gas-suspended extract generated by the blower feed and improves the extraction results obtained, although it imposes the additional burden of obtaining adequate water separation at 230. The second alternative avoides the water separation burden and can be preferable as the simpler one if the lesser extraction results obtained are sufficient for the particular conditions at hand. When the second alternative is employed the discharge line 228 still functions effectively to carry off the gas-suspensed extract by reason of the fact that the feed from auxiliary blower 224 then becomes an external one that results in increasing kier pressure enough to leave discharge line 228 and dump outlet 232 as the easiest path for escape of the gas-suspended extract.

Otherwise, the kier 100 is fitted with vent and relief valves, as indicated in FIG. 9 at 234 and 236, in the usual manner and for the usual purposes, and the operating system illustrated in FIG. 9 is well suited for automatic monitoring from suitably located sensors employed to trigger operation of the sytem components in appropriate sequence and timed duration.

The application of treating formulations to piece goods at short liquor ratios in the manner presently disclosed not only provides for application and distribution of the treating formulation with exceptional effectiveness, but also has an important bearing and particular advantage in terms of the practical aspects of system operation and at any other time when kier temperature must be prevented from rising unduly. This latter advantage follows from the fact that the jetted inert gas by which the aspirating influence is provided for circulation of the goods has the collateral effect of generating a moisture mist during application and distribution of the treating formulation, and as this mist permeates the kier atmosphere as its generation continues the blower feed to the aspirating jet which draws from the kier atmosphere becomes moisture laden at an early operating stage which means that the heat transfer efficiency at the heat exchanger provided to control blower feed temperature is significantly improved to render such control relatively easy in comparison with the problem that would exist if only dry air or gas were involved. In addition, when the time comes to elevate temperature for dye fixation, this moist condition of the kier atmosphere significantly improves the effectiveness with which heat energy is transferred from the blower to the material being processed and accounts in large measure for the rapid rates at which temperature can be elevated according to the present invention in reliance on blower heat input together with steam injection.

Piece goods dyeings that are well penetrated and exceptionally level can be obtained readily under mill conditions according to the present invention which has been described in detail above for purposes of illustration only, and which is not intended to be limited by this description or otherwise to exclude any variation or equivalent procedure or arrangement that would be apparent from, or reasonably suggested by, the foregoing disclosure to the skill of the art.

We claim:

1. In apparatus adapted for wet processing textile strand material in which means is included for causing the strand material to circulate in traveling strand form to and from a pleated accumulation within an enclosure for such processing, the improvement which comprises an extraction jet disposed between the point of strand circulation from said pleated accumulation and said circulating means for subjecting the circulating strand material to an aspirating influence directed oppositely to the direction of strand material circulation, means for selectively supplying an inert gas to said jet to generate an aspirating influence thereat for extracting said strand material following wet processing and means for application of a suction influence ahead of said extraction jet.

2. The apparatus improvement defined in claim 1 wherein said oppositely directed aspirating influence generates a gas-suspended extract externally of said circulating strand material, and said suction means is provided for recovering and carrying off said extract.

3. The apparatus improvement defined in claim 1 wherein said inert gas is air.

* * * * *